US007832216B2

(12) United States Patent
Astra

(10) Patent No.: US 7,832,216 B2
(45) Date of Patent: Nov. 16, 2010

(54) APPARATUS FOR COOLING

(75) Inventor: Eugene Astra, Iffley (GB)

(73) Assignee: Siemens Plc, Frimley, Camberley (GB)

( * ) Notice: Subject to any disclaimer, the term of this patent is extended or adjusted under 35 U.S.C. 154(b) by 323 days.

(21) Appl. No.: 11/723,165

(22) Filed: Mar. 16, 2007

(65) Prior Publication Data

US 2007/0214821 A1 Sep. 20, 2007

(30) Foreign Application Priority Data

Mar. 17, 2006 (GB) ..... 0605353.2
Jun. 1, 2006 (GB) ..... 0610733.8

(51) Int. Cl.
*F25B 19/00* (2006.01)

(52) U.S. Cl. ..... 62/51.1; 62/50.2

(58) Field of Classification Search ..... 62/51.1, 62/50.2, 45.1, 457.9
See application file for complete search history.

(56) References Cited

U.S. PATENT DOCUMENTS 4,745,771 A * 5/1988 Linner et al. ..... 62/264
4,918,928 A * 4/1990 Morioka et al. ..... 62/51.1
5,174,122 A * 12/1992 Levine ..... 62/50.2

FOREIGN PATENT DOCUMENTS

EP 0916890 A2 5/1999
JP 6-185844 7/1994

* cited by examiner

*Primary Examiner*—Melvin Jones
(74) *Attorney, Agent, or Firm*—Crowell & Moring LLP

(57) ABSTRACT

Apparatus for cooling a cooled equipment, comprising:

a cryogen vessel (10) housing the cooled equipment;

a gaseous cryogen filling the cryogen vessel;

a refrigerator (12) having a cooling surface exposed to the interior of the cryogen vessel (10) so as to cool the gaseous cryogen; and a gas current generator arranged to cause circulation of the gaseous cryogen freely within the cryogen vessel, such that the gaseous cryogen is cooled by the refrigerator, and is warmed by heat from the cooled equipment, thereby cooling the cooled equipment.

10 Claims, 1 Drawing Sheet

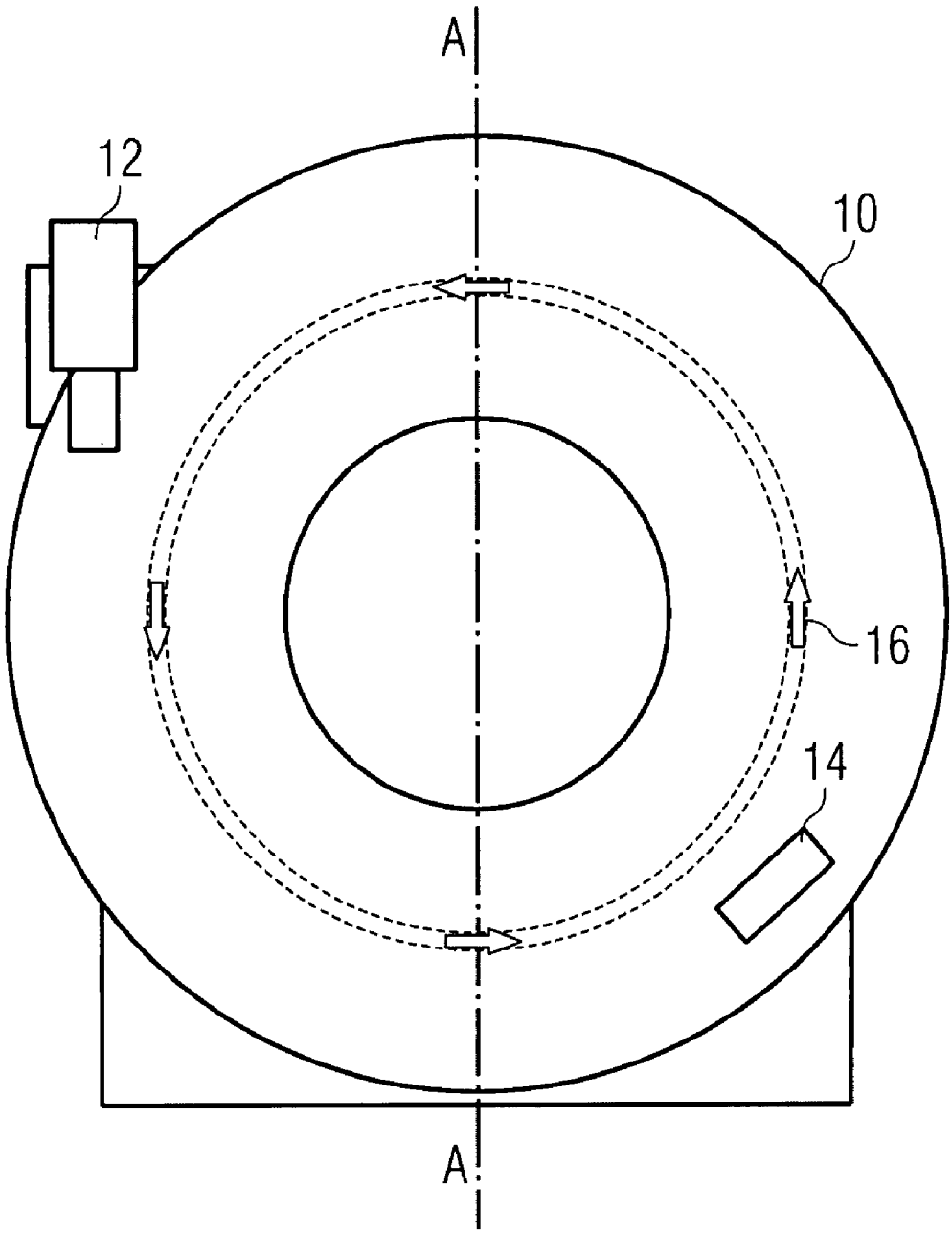
A
12
10
16
14
A

APPARATUS FOR COOLING

This application claims the priority of Great Britain patent document 0605353.2, filed Mar. 17, 2006, the disclosure of which is expressly incorporated by reference herein.

The present invention relates to methods and apparatus for cryogenically cooling structures such as superconducting magnets.

BACKGROUND OF THE INVENTION

Structures such as superconducting magnets are typically cooled by at least partial immersion in a bath of liquid cryogen. For superconducting structures, such as superconducting magnet coils for MRI (Magnetic Resonance Imaging) or NMR (Nuclear Magnetic Resonance) scanners and the like, the cryogen used is liquid helium. Typical cryogen baths hold volumes of liquid helium in the order of 1000 liters.

During the final stages of manufacture, a cryogenically cooled superconductive magnet is subjected to training cycles. That is, current is repeatedly ramped up until the magnet holds the current without quenching. Since one or more quench events are likely to occur during these training cycles, a significant amount of liquid cryogen is consumed.

The expression 'ramping up' refers to the progressive introduction of current into a superconducting magnet. Once ramped to full current, producing the full magnetic field, a superconducting magnet will remain in this state until 'ramped down', that is, the current is removed from the magnet and the generated magnetic field falls to zero.

The increasing cost and global shortages of liquid helium necessitate reductions of the quantity of liquid helium used in cooling superconductive magnets to low temperature and lost in training cycles, as well as amount of helium stored in the cryogen baths. There are a number of patents proposing spacers to reduce the required helium volume, or various types of heat links for cooling superconductive parts of the magnet with reduced helium level (e.g. EP1522867), avoiding the need for immersion in a cryogen bath. In some examples, a relatively small quantity of helium is circulated around a cooling loop: a thermally conductive pipe partially filled with liquid helium and in thermal contact with the cooled equipment, in conjunction with a cryogenic refrigerator arranged to keep the helium in its liquid state (WO9508743).

All these solutions require additional expensive components. They increase risk of failure, e.g. leaking cooling pipes. They can be potentially dangerous in case of a quench. For example, the spacers restrict gas flow paths, or coils overheat as cooling loops can not transfer the quench energy fast enough. As the maximum amount of helium that could be stored in the magnet is reduced, special solutions for keeping the magnet cold during transportation are required, such as tanks with frozen nitrogen as described in copending United Kingdom patent application GB 0515936.3.

SUMMARY OF THE INVENTION

One object of the present invention therefore is to provide a method and apparatus for cooling articles such as superconducting magnet coils, which avoids the need for immersion in a bath of liquid cryogen.

Another object of the present invention is to provide a method and apparatus for cooling articles such as superconducting magnet coils, which avoids the need for cooling loop apparatus, and enables the use of conventional cryogen vessels with much reduced cryogen inventory.

These and other objects and advantages are achieved by the method and apparatus according to the present invention in which, rather than immersion of cooled equipment in a bath of liquid cryogen, or circulation of cryogen through a thermally conductive tube, a current of cooled gaseous cryogen is circulated freely within a cryogen vessel, around the cooled equipment.

In one embodiment of the present invention, the gaseous cryogen is circulated around the cooled equipment by forced venting, for example by a fan.

In other embodiments of the invention, gas is circulated by natural thermal convection around a loop path.

Such embodiments have been found to be particularly suitable for cooling magnets of asymmetric design. Such an arrangement would typically comprise a refrigerator and/or a heater positioned asymmetrically to create a sufficient convection flow. The use of helium gas as the gaseous cryogen in such embodiments is particularly advantageous, due to the very significant change in the density of helium with temperature.

Operation of the present invention has been experimentally demonstrated by successfully ramping a commercial superconducting NMR magnet to full field and down to zero field when held within a conventional cryogen vessel with asymmetrically positioned refrigerator containing gaseous helium cryogen but no liquid helium.

BRIEF DESCRIPTION OF THE DRAWINGS

The above, and further, objects, advantages and characteristics of the present invention will become more apparent from consideration of the following description of certain embodiments thereof, in conjunction with the accompanying drawing, wherein:

The signal FIGURE shows an example of a solenoidal cryostat, as used for housing solenoidal magnet coils, cooled according to the present invention.

DETAILED DESCRIPTION OF THE INVENTION

Some known cryogenic cooling systems are provided with a recondensing refrigerator. The liquid cryogen cools the cooled equipment by boiling, drawing the required latent heat of evaporation from the cooled equipment, holding its temperature at the boiling point of the liquid cryogen. The recondensing refrigerator serves to remove this latent heat from the boiled-off cryogen, returning it to its liquid state, such that the overall boil-off of cryogen from the system is zero, or practically zero. The liquid cryogen is in thermal equilibrium with gaseous cryogen. Such zero boil-off systems are most suitable for modification to cooling by the gas circulation cooling proposed by the present invention, as they usually have a heater for evaporating excess helium, in addition to the recondensing refrigerator for recondensing boiled-off cryogen. The heater is provided to counter possible over-cooling of the helium. If the recondensing refrigerator is too effective, the cryogen may be cooled such that little boil off occurs, and an upper part of the cooled equipment is no longer cooled by boiled-off cryogen, and the lower part of the cooled equipment may reach a lower temperature than the upper part. By positioning the refrigerator and heater asymmetrically on opposing sides of the cooled equipment, a convection gas flow sufficient for keeping the equipment in a superconducting state is created.

The FIGURE illustrates an example of convection gas flow generated by a refrigerator and a heater, according to an embodiment of the present invention. In the example, an annular cylindrical cryogen vessel 10 is illustrated, being the type of vessel normally used to house a solenoidal superconducting magnet for an MRI or NMR scanner. The vessel 10 is filled with a gaseous cryogen, such as helium, nitrogen, argon, hydrogen or neon. As is conventional in a zero boil-off cryostat, a recondensing refrigerator 12 is provided. It has a recondensing surface exposed to the interior of the cryogen vessel 10. The recondensing refrigerator is preferably located asymmetrically, to one side of the vessel, on the curved wall. In the illustrated embodiment, a heater 14 is provided within the cryogen vessel, and is situated in a position suitable to set up a thermal convection current 16 in the gaseous cryogen. A suitable position for the heater 14 is diametrically opposite the recondensing refrigerator, as illustrated in the FIGURE.

Preferably, although not necessarily, the heater and the refrigerator should be placed on opposite sides of centre line AA, and the refrigerator should be located higher than the heater, in the vertical direction, since this aids in the setting up of a convection current. In use, as will be apparent to those skilled in the art, the refrigerator 12 cools the cryogen gas. The density of the cooled gas will increase, markedly so in the case of helium, and the cooled gas will tend to descend away from the refrigerator in the direction of the circulation 16. On the other hand, the heater 14 will heat the cryogen gas which will expand, markedly so in the case of helium. This will cause the cryogen gas to rise, in the direction of the circulation 16.

The circulation 16 of gas established by the positioning and operation of the refrigerator 12 and the heater 14, according to the present invention causes a low of gas freely within the cryogen vessel, around any cooled equipment which may be placed within the vessel, such as a solenoidal superconducting magnet for an MRI or NMR imaging system. Care must be taken to ensure that the cooling capacity of the refrigerator 12 is not exceeded by the total heat provided into the system, including heat generated by the cooled equipment, heat influx from the exterior, and the thermal output of heater 14.

In practice, a small quantity of liquid cryogen may be left in the vessel, in thermal equilibrium with the gaseous cryogen to ensure that an adequate supply of cryogen gas is always present. This liquid cryogen may be generated, or maintained, by the recondensing effect of the refrigerator.

A cooling arrangement according to the present invention accordingly requires very little cryogen, and may be arranged to produce zero boil-off and a lightweight system. Cooling with low or zero liquid cryogen level using the convection or forced gas circulation according to the present invention has the following advantages. The cost of training cycles is reduced, as the volume of liquid cryogen lost in each quench is significantly less. The cost of a quench is largely made up of the material cost of liquid cryogen lost as a result of the quench, plus the cost of cryogen used to cool the cooled equipment back to operating temperature once the quench is over. Most of cryogen lost in a quench is not evaporated, but rather flushed out of the cryogen vessel by expanding gas. It is known that the level of cryogen left in the magnet after quench does not depend much on the initial cryogen level: starting with a 100% full or a 50% full magnet, you finish with 20% fill in either case. According to the present invention, relatively little cryogen is provided in the vessel, and so relatively little cryogen is lost during the quench. The cost of on-site installation is reduced, as relatively little, or no, liquid cryogen is required after shipment.

For short shipping routes, the system may be shipped with the vessel 10 filled with cryogen gas, which is used for cooling the equipment according to the present invention; for longer routes, such as a month-long sea freight, the cryogen vessel could be filled to its full volume, with cryogen boiling off during shipping to maintain the cooled equipment at its operating temperature. Such an arrangement is not possible with low volume systems, which require cold storage devices or refrigerators running during shipment. The former are expensive; the latter are not allowed on planes and are expensive to run during road or sea freight. A system such as provided by the present invention, that can be filled full for shipping but can operate virtually empty, is an attractive option.

Advantageously, the risk of damage to the cooled equipment in the case of quench is reduced, as the quench pressure is reduced. A much reduced mass of cryogen is present in the vessel 10, so the gas pressure inside the vessel is much reduced during a quench, since there is not a large volume of liquid cryogen being expelled. Furthermore, this feature of having a reduced maximum gas pressure leads to cheaper cryogen vessel 10 design as the maximum gas pressure during a quench is lower than in known systems.

Similarly, in view of the much reduced quantity of liquid cryogen provided in the cryogen vessel, escape paths for expelled cryogen, known as quench pipes or access turrets, may be made much smaller than in conventional systems. This will result in reduced cost of manufacture, and reduced heat influx through quench pipes.

In a preferred embodiment, a zero boil-off cryogen vessel for cooling equipment such as superconducting magnets can successfully operate without, or with very little, liquid cryogen, if the asymmetric positioning of the refrigerator and any heater which may be present guarantees sufficient convection gas flow. In certain embodiments, the heater is not required. The position of the refrigerator, offset from the centre line AA, is sufficient to maintain a circulation current. The refrigerator should operate continuously to keep the convection current going.

Apart from the cryogen material cost reduction, liquid-free magnets such as provided by the present invention experience lesser stresses in the case of a quench. In alternative embodiments, cooling is provided by a refrigerator, but the required circulation of gaseous cryogen is provided or assisted by a gas current generator, such as a fan.

A Siemens® MAGNETOM Avanto® magnet was successfully ramped up to full field, held at full field and ramped down to zero while bring cooled by cooled gas circulation according to the present invention, with no liquid cryogen present in the cryogen vessel. The magnet operated without quenching.

Although particularly described with reference to recondensing refrigerators, the present invention may also be applied to gaseous cryogens which are used at temperatures higher than their boiling points, and wherein the refrigerator does not operate as a recondensing refrigerator. The refrigerator in such embodiments operates as a cooling refrigerator, and no liquid cryogen will be present within the cryogen vessel. Such embodiments could be especially useful in systems using so-called high temperature superconductor (HTS) wire materials with a critical temperature well above the boiling point of helium but below the boiling point of nitrogen, such as $MgB_2$ with critical temperature of 39K. Liquid neon, a natural cryogen for such materials, is expensive. An embodiment of the present invention employing gaseous helium at a temperature of about 20K could usefully be employed to cool equipment using such HTS wire. Refrigerators with lower temperature of 10 or 20K are cheaper than recondensing 4.2K cold heads.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. Apparatus for cooling a cooled equipment, comprising:

a cryogen vessel housing the cooled equipment;

a gaseous cryogen filling the cryogen vessel;

a refrigerator having a cooling surface exposed to the interior of the cryogen vessel so as to cool the gaseous cryogen; and a gas current generator arranged to cause circulation of the gaseous cryogen freely within the cryogen vessel, such that the gaseous cryogen is cooled by the refrigerator, and is warmed by heat from the cooled equipment, thereby cooling the cooled equipment;

wherein the gas current generator comprises a heater situated within the cryogen vessel, in a position suitable to set up a thermal convection current in the gaseous cryogen.

2. Apparatus according to claim 1 wherein the gas current generator comprises a fan.

3. Apparatus according to claim 1, wherein the heater is situated diametrically opposite the refrigerator, the heater and the refrigerator being placed on opposite sides of a vertical centre line with the refrigerator located higher than the heater in the vertical direction.

4. Apparatus for cooling a cooled equipment, comprising:

a cryogen vessel housing the cooled equipment;

a gaseous cryogen filling the cryogen vessel;

a refrigerator having a cooling surface exposed to an interior of the cryogen vessel so as to cool the gaseous cryogen and positioned asymmetrically on the cryogen vessel so as to cause circulation of the gaseous cryogen by natural thermal convection freely within the cryogen vessel, such that the gaseous cryogen is cooled by the refrigerator, and is warmed by heat from the cooled equipment, thereby cooling the cooled equipment.

5. Apparatus according to claim 4, further comprising a heater within the cryogen vessel, situated in a position suitable to assist circulation of thermal convection current in the gaseous cryogen.

6. Apparatus according to claim 5, wherein the heater is situated diametrically opposite the refrigerator, the heater and the refrigerator being placed on opposite sides of a vertical center line with the refrigerator located higher than the heater in the vertical direction.

7. Apparatus according to claim 1, wherein the gaseous cryogen comprises at least one of: helium, nitrogen, argon, hydrogen and neon.

8. Apparatus according to claim 7 wherein the gaseous cryogen comprises helium.

9. Apparatus for cooling a cooled equipment, comprising:

a cryogen vessel housing the cooled equipment;

a gaseous cryogen filling the cryogen vessel;

a refrigerator having a cooling surface exposed to the interior of the cryogen vessel so as to cool the gaseous cryogen; and a gas current generator arranged to cause circulation of the gaseous cryogen freely within the cryogen vessel, such that the gaseous cryogen is cooled by the refrigerator, and is warmed by heat from the cooled equipment, thereby cooling the cooled equipment;

wherein a quantity of liquefied gaseous cryogen in thermal equilibrium with the gaseous cryogen is provided within the cryogen vessel, sufficient to ensure that an adequate supply of gaseous cryogen gas is present, said liquefied gaseous cryogen being out of contact with the cooled equipment.

10. Apparatus according to claim 1, wherein the cryogen vessel is of annular cylindrical shape.

* * * * *